United States Patent [19]

Gehring

[11] Patent Number: 4,641,688

[45] Date of Patent: Feb. 10, 1987

[54] WEFT THREAD BRAKING MECHANISM HAVING A STEPWISE CONTROLLABLE BRAKING EFFECT

[75] Inventor: Fritz Gehring, Lindau, Fed. Rep. of Germany

[73] Assignee: Lindauer Dornier Gesellschaft mbH, Lindau, Fed. Rep. of Germany

[21] Appl. No.: 807,165

[22] Filed: Dec. 9, 1985

[30] Foreign Application Priority Data

Dec. 20, 1984 [DE] Fed. Rep. of Germany ..... 3446567

[51] Int. Cl.[4] ..... D03D 47/34

[52] U.S. Cl. ..... 139/450; 188/65.1; 242/149

[58] Field of Search ..... 139/429, 450; 242/149; 188/65.2

[56] References Cited

U.S. PATENT DOCUMENTS 4,512,375 4/1985 Deborde et al. ..... 139/450

FOREIGN PATENT DOCUMENTS 39561 11/1981 European Pat. Off. .
2131302 12/1972 Fed. Rep. of Germany .
2300734 10/1976 Fed. Rep. of Germany ..... 139/450
3226250 3/1983 Fed. Rep. of Germany .
310476 12/1955 Switzerland .
598981 3/1978 U.S.S.R. ..... 139/450

*Primary Examiner*—Henry S. Jaudon
*Attorney, Agent, or Firm*—W. G. Fasse; D. H. Kane, Jr.

[57] ABSTRACT

A weft thread brake for shuttleless weaving machines includes two leaf springs or lamellae which rest against each other in a spring elastic manner. The thread, such as a weft thread, passes through a passage formed between the two leaf springs as the thread is being pulled off a supply reel or bobbin whereby the two leaf springs apply a braking action to the thread. In their basic position the leaf springs exert a first step of a defined braking action on the thread. Additionally, controllable members are arranged for cooperation with the leaf spring or springs to increase or decrease the pressure of the two leaf springs toward each other. Electromagnets, compression elements, or the like, are suitable for this purpose, whereby the actuation of these control members increase the braking action even to the extent of clamping the weft thread between the leaf springs if desired.

8 Claims, 6 Drawing Figures

FIG. 1a
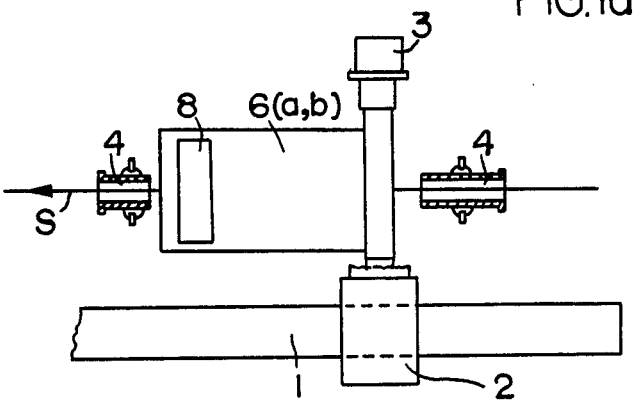
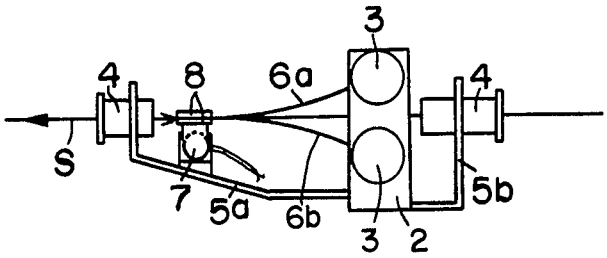
FIG. 1b

WEFT THREAD BRAKING MECHANISM HAVING A STEPWISE CONTROLLABLE BRAKING EFFECT

FIELD OF THE INVENTION

The invention relates to a weft thread braking mechanism having a stepwise controllable braking effect in shuttleless weaving machines in which the weft threads are pulled off from a plurality of supply thread reels or bobbins, whereby each thread runs through its own thread brake.

DESCRIPTION OF THE PRIOR ART

In the present context it is intended that a stepwise controllable braking effect means the possibility of switching between two or more braking conditions in which the thread brake exerts different braking forces and hence different braking effects on the respective weft thread.

Prior art weft thread brakes are used in shuttleless weaving machines to enable the weft thread inserting member to grip the selected thread in a stretched out or tensioned condition. In a shuttleless weaving machine the thread inserting member and the thread withdrawal member each carrying respective grippers, are subjected to substantial accelerations and decelerations during the weft thread insertion when these members move laterally into and out of the loom shed. Once the weft thread has been gripped, it is transported rapidly by the insert member to the center of the loom shed, whereby the thread is rapidly reeled off its supply bobbin. In the center of the loom shed the thread is tranferred to the gripper of the withdrawal member. During this transfer the reeling off of the thread is interrupted for a short period of time. Upon the completion of the transfer, the withdrawal member and its gripper rapidly pull the thread through the loom shed whereupon the thread is released at the other side of the insert path, whereby the speed of the thread is stopped. During the entire time of thread insertion and withdrawal, it is necessary that the thread remains taut. In other words, the thread may not keep running and form curls during the short interruption of the reeling-off during the thread transfer. It is the purpose of the above mentioned weft thread brakes to meet this requirement that the formation of loops and curls must be avoided, especially during the thread transfer in the center of the loom shed. In this connection it is known to provide the weft thread brakes not only with a continuously uniform braking action or effect on the thread, but to cause different braking actions with different braking forces during different phases of the thread insertion.

Swiss Patent (CH-PS) No. 310,476 discloses, for example, a weft thread brake including a yielding and a rigid brake body forming a gap therebetween through which the thread is pulled. A braking action is applied to brake the thread by pressing the two bodies toward each other. One of the two brake bodies is connected to a mechanical control device which permits adjusting several different brake positions. In one position the two brake bodies are entirely spaced from each other. In at least two further brake positions which may be periodically established, different braking effects are achieved. The prior art control mechanism comprises a cam and lever drive, whereby it becomes possible to apply to a weft thread that is being pulled off a supply reel, different braking actions in a stepwise manner. However, due to the cam drive the braking program or sequence is fixed once and for all and cannot be varied during the operation, nor can it be adapted to different braking requirements, except perhaps by using different cam drives at different times. Besides, such a cam drive, even if only one is used, requires a substantial number of parts including the cam drive mechanism and the levers so that the control mechanism is expensive and additionally requires a substantial space for its installation. Further, using a piston type rigid brake body in combination with an elastically yielding steel tape forming the other yielding brake body, makes the thread guiding difficult. As a result, damage to the thread while it runs through such a brake mechanism, cannot be altogether avoided.

In addition to the just described thread brake mechanism according to Swiss Patent No. 310,476, other thread brake types are known in the art and they are distinguished from one another by the shape and arrangement of the brake components. Thus, besides the brake body which functions much like a piston, there are disk brakes known in the art in which two disks are pressed toward each other by a spring force. Such a disk brake for braking a thread is known, for example, from European Patent Application No. 039,561 in which the thread runs through the gap between the two disks. By varying the spring force which presses the two disks toward each other, the braking effect may be increased or decreased. In this known device the two brake disks rest against each other and are continuously under the bias of two separate spiral, or rather helical springs so that the full braking force is normally effective. Electromagnetic means are used to eliminate the biasing spring pressure of one or both helical springs, whereby the braking force can be reduced in stages, or it may be eliminated altogether. One such brake may be provided for each of the weft threads which are used in a weaving machine operating with a plurality of thread supply bobbins so that each bobbin has its own thread brake. In this type of arrangement it is possible that all thread brakes are controlled in a stepwise manner in accordance with a control program which depends on the weaving pattern so that the braking force corresponds to the required stepwise braking force.

However, disk brakes have the basic disadvantage that in the rest position the two disks contact each other generally along a circular contact line. Thus, the thread passing through the gap between the disks is contacted only at the contact location or at the two-contact location as it enters and exits from the gap between the two brake disks. As a result, the entire braking effect is limited to these two locations, whereby the thread is exposed to a substantial stress at these two locations. Since each thread is twisted, a back-up of the thread twisting results when the thread is pulled through the brake. Even worse, a loop formation or curling formation may be caused even upstream of the brake under certain circumstances. Such curls stop the function of the brake when the curls pass through the brake. Besides, the thread characteristics which depend on the twisting may be changed in an undesirable manner due to the untwisting, or at least partial untwisting, of the thread as it passes through the brake. Knots or other thickened portions of the thread also cause difficulties when they pass through the disk brake. Such knots or thickened portions can cause an especially strong braking action, whereby tearing of the thread cannot be avoided, at least under certain circumstances.

Another drawback of the disk brake according to European Patent Application No. 039,561 is seen in that the electromagnetic control of the thread brake requires a substantial structural effort and expense due to the fact that each of the two helical springs requires its own electromagnetic means, whereby the space requirements are also substantial and the installation imposes substantial difficulties.

Yet another type of thread brake employing at least one leaf spring is described in German Patent Publication (DE-OS) No. 2,131,302. If one leaf spring is used, the abutment is a bolt. If two leaf springs are used one of the leaf springs forms the abutment. In the just mentioned German Patent Publication No. 2,131,302 two leaf springs are secured to a pair of rotatably mounted support members, whereby these support members are rotatable symmetrically relative to the feed advance direction of the thread by means of a gear type coupling. The coupling of the two rotatable mounting or support members is accomplished through gear wheels. The leaf springs do not have the above mentioned disadvantages of disk springs or brakes to any substantial degree. Additionally, the leaf springs treat the thread in a gentler manner than the disk springs. Leaf springs also are better suitable than disk springs for passing the thread through the spring brake even if there are knots in the thread. However, the thread brake according to German Patent Publication No. 2,131,302 also has its drawbacks because, although permitting the adjustment of a braking effect, it does not permit a stepwise control of the braking effect while the weaving operation is in progress. Above all, it is not possible with this leaf spring type of brake to individually apply braking actions to the individual threads which are pulled off a plurality of supply bobbins or reels.

German Patent Publication (DE-OS) No. 3,226,250 discloses still another weft thread brake in which leaf springs or lamellae are used as the spring members. This prior publication deals in detail with the problem that different tensions must be applied to the weft thread as it is being pulled off a supply reel, whereby it is desirable that the changes follow each other in a rapid sequence of phases. In the known device a bendable lamella is arranged between a stationary lamella and a movable lamella in such a way that the weft thread is blocked between the stationary lamella and the bendable lamella when the movable lamella is pressed against the bendable lamella by a reset spring. Additionally, the weft thread is held with a light braking action between the stationary lamella and the bendable lamella when the movable lamella is held in a spaced position relative to the stationary lamella under the action of a control member. The control member shifts the movable lamella between two positions. In one position the movable lamella rests against the back of the bendable lamella and in the other position the movable lamella is lifted off the bendable lamella. This switching of the movable lamella is accomplished by means of a pin type control member which shifts the movable lamella back and forth. The arrangement is such that an entire row of supply bobbins is located in a common plane with the respective thread brakes. A tiltable sector member carries one control pin for each brake for influencing all brakes at the same time.

A serious disadvantage of the thread brake according to German Patent Publication No. 3,226,250 is seen in that the thread tension is simultaneously slackened for all threads being pulled off the reels including those threads which are not selected for a weft insertion. Besides, the mechanism of the sector member with its control pins can be realized only for a limited number of brakes or supply reels and that only if the brakes are located in a common, single plane.

OBJECTS OF THE INVENTION

In view of the foregoing it is the aim of the invention to achieve the following objects singly or in combination:

- to construct a thread brake in such a way that its control will avoid the above described disadvantages while simultaneously assuring that each weft thread is kept taut individually as it is being pulled off its supply reel;
- to make sure that each individual thread remains clamped individually for the length of time during which the thread is not needed for the weft thread insertion;
- to apply such a stepwise braking action individually to each thread, that the inherent thread characteristic of the threads including twisted threads, is not modified, by the stepwise braking action; and
- to employ simple control means which may be individually provided for each thread brake, yet do not require much space for their installation.

SUMMARY OF THE INVENTION

The above objectives have been achieved according to the invention in a thread brake which is characterized in that each thread brake is provided with an additional, individual control member which is controllable as desired in its effectiveness on the lamellae constituting the thread brake proper. The main advantage of the invention is seen in that the tension for each thread is individually maintained without regard to the tension of any of the other threads and in a stepwise manner.

BRIEF DESCRIPTION OF THE DRAWINGS

In order that the invention may be clearly understood, it will now be described, by way of example, with reference to the accompanying drawings wherein:

FIG. 1*a* is an elevational view of a thread brake according to the invention employing an electromagnet as a control member;

FIG. 1*b* is a top plan view of the thread brake of FIG. 1*a;*

Figure 2A:
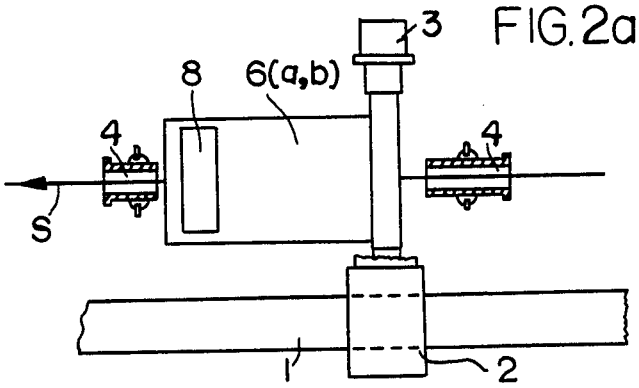
FIG. 2*a* is an embodiment similar to that of FIGS. 1*a* and 1*b,* but employing an electromagnet mounted on a movable part of the thread brake.

DETAILED DESCRIPTION OF PREFERRED EXAMPLE EMBODIMENTS AND OF THE BEST MODE OF THE INVENTION

FIGS. 1*a* and 1*b* show a machine frame member 1 carrying a support block 2 for mounting leaf springs 6*a* and 6*b* with the aid of two mounting bolts 3. A first mounting arm 5*a* is secured to the support block 2 and carries a thread guide 4 as well as an electromagnet 7. A further mounting arm 5*b* also secured to the support block 2 carries another thread guide eye 4. The two eyes 4 are aligned with each other to define a path for the weft thread S. As indicated by the arrow, the weft thread S travels from right to left through the thread brake mechanism, whereby the two lamella type leaf springs 6*a* and 6*b* form a funnel type configuration through which the weft thread S is pulled off the respective supply reel or bobbin not shown. By turning the mounting bolts 3 it is possible to cause the leaf springs 6*a* and 6*b* to contact each other with a larger or smaller force or not to contact each other at all. Thus, it is possible to adjust the leaf springs 6*a* and 6*b* into a desired basic position in which a first step in the brake force or effect is provided. These features as such are not part of the invention and they are disclosed in German Patent Publication No. 2,131,302 discussed above. Therefore, a more detailed description is omitted.

As best seen in FIG. 1*b* the mounting arm 5*a* carries an electromagnet 7 connectable to a source of electrical power not shown. A magnetic armature 8 is located opposite the electromagnet 7. Such an armataure 8 is mounted on each of the leaf springs 6*a* and 6*b* or at least on the outside of leaf spring 6*a*. When the magnet 7 is energized, the armature 8 is pulled toward the magnet 7, whereby the magnetic force exerted on the armature 8 is added to the spring force of the thread brake. By switching the magnet on and off it is possible to provide an alternately weaker or stronger braking effect. If necessary, this braking effect can be increased to such an extent that a complete clamping of the weft thread passing through the brake is achieved.

Figure 2B:
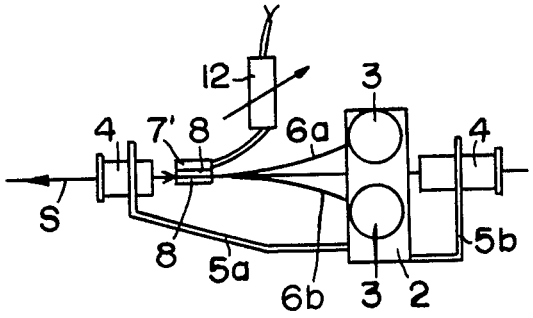
FIG. 2*b* is a top plan view of the embodiment of FIG. 2*a;*

The embodiment illustrated in FIGS. 2*a* and 2*b* corresponds in its basic structure to the embodiment shown in FIGS. 1*a* and 1*b*, except that in the embodiment of FIGS. 2*a* and 2*b* the electromagnet 7′ is energized through a variable control 12 and is not supported on a machine frame member but on the leaf spring 6*a* itself. The armature 8 is mounted on the leaf spring 6*b*.

The variable control 12 may, for example, be a variable resistor. The operation of the embodiment of FIGS. 2*a* and 2*b* is basically the same as that of the embodiment of FIGS. 1*a* and 1*b*, except that the magnetic force may be varied by varying the control member 12, whereby a finer adaptation of the braking effect to the type of the thread material is possible. The fine control of the brake force may also take into account any other requirements of the particular weaving machine. As in FIG. 1*a* and FIG. 1*b*, several different steps may be provided in the braking action and not only two such steps between a completely opened brake and a position in which the springs 6*a* and 6*b* firmly clamp the weft thread in place.

Figure 3A:
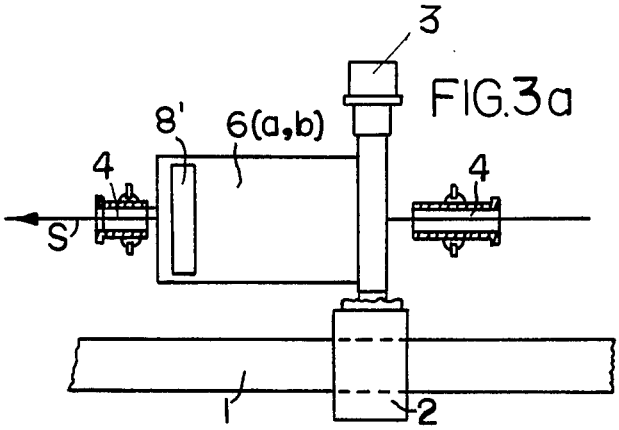
FIG. 3*a* is an elevational view with a pressure responsive control member.
Figure 3B:
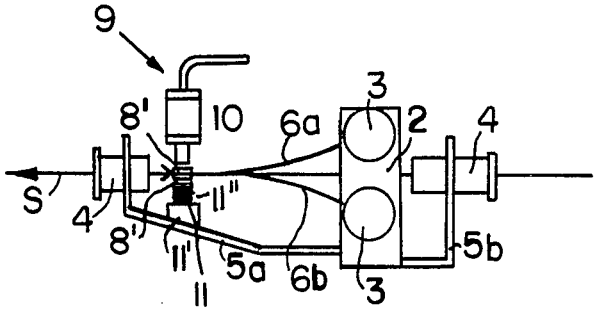
FIG. 3*b* is a top plan view of the embodiment of FIG. 3*a.*

FIGS. 3*a* and 3*b* show an example embodiment in which the electromagnet has been replaced by a fluid pressure operated control member 9 such as a piston cylinder device connected to a source of pressure not shown. A liquid or gaseous medium can be used for the pressurizing of the control member 9. The cylinder of the control member 9 is rigidly secured to a frame portion such as the frame member 1 of the weaving machine. The control member 9 with its piston or pressure applicator 10 is located in such a position that the piston 10 is located next to the leaf springs 6*a*, 6*b*. An abutment 11 carried by the arm 5*a* on a mounting block 11′ cooperates with the piston 10 in applying compression to the leaf springs 6*a*, 6*b*. The abutment 11 may either be rigidly mounted or it may be elastically yielding with the aid of a helical spring 11″. Each leaf spring 6*a* and 6*b* is provided with its pressure plate 8′. These pressure plates 8′ are arranged substantially in the same manner as the armatures 8 in FIGS. 1 and 2. When the control member 9 is charged with a pressure medium, the piston 10 moves toward the abutment 11, thereby pressing the two pressure plates 8′ together, whereby the braking effect of the two springs 6*a*, 6*b* on the weft thread S is increased. Instead of using fluid pressure an electromagnetically operated pressure applicator or piston may be used.

By making the abutment member 11 adjustable against the force of the spring 11″ it is possible to position the abutment member 11 in any desired position relative to the control member 9. The abutment member 11 may, for example, be a threaded bolt which is engaged in a threaded hole in the mounting block 11′. However, any other type of adjustable abutment may be used. In the embodiment of FIGS. 3*a* and 3*b*, again several compression steps may be employed, whereby also several steps or stages in the braking effect can be realized between a fully opened position of the brake and a firm clamping of the weft thread S between the leaf spring 6*a* and 6*b*.

Incidentally, the embodiments of FIGS. 1*a*, 1*b*, and 2*a*, 2*b* may also be provided with adjustable abutment members arranged for cooperation with the respective electromagnet 7 or 7′.

All embodiments of the weft thread brake according to the invention have the above mentioned advantages of leaf spring thread brakes. Additionally, the present brakes can be employed in connection with weaving machines without any restrictions, whereby any desired number of weft thread supply reels may be equipped with such brakes which do not need to be located in a common plane. The electromagnets are relatively small and their installation is not complicated so that the structural effort and expense as well as the required space, are hardly noticeable. Additionally, all the brakes can be individually controlled through a relatively simple programmable control system, whereby the program would take into account the thickness and characteristics of the particular thread, as well as the timing at which the particular braking action must take place. Additionally, conventional weft thread brakes with leaf springs can be modified in accordance with the teaching of the present invention for achieving a stepwise control of the braking mechanism. Electromagnetic attraction may be used as well as repulsion.

Although the invention has been described with reference to specific example embodiments, it will be appreciated, that it is intended to cover all modifications and equivalents within the scope of the appended claims.

What I claim is:

1. A weft thread brake for applying a stepwise controllable braking effect to a weft thread, comprising two leaf springs resting against each other and forming a funnel type passage for the respective weft thread, said two leaf springs having a normal biasing force for applying a first step in the braking effect individually to said weft thread, mounting means (1, 2, 3) for mounting said two leaf springs so that the position of at least one of said two leaf springs is changeable relative to the position of the other leaf spring, and individually controllable force application means operatively arranged for directly applying to said leaf springs a stepwise increase or decrease of a force directed substantially perpendicularly to said leaf springs, whereby said normal biasing force of said leaf springs is changed and the respective braking effect is individually controlled in a stepwise manner for said weft thread.

2. The weft thread brake of claim 1, wherein said individually controllable force application means comprise electro-magnetic means operatively arranged for directly applying pressure to said leaf springs.

3. The weft thread brake of claim 2, wherein said electro-magnetic means comprise an armature directly attached to one of the springs and an electro-magnet arranged for cooperation with said armature for changing the position of at least one of said leaf springs and thus the braking effect.

4. The weft thread brake of claim 3, further comprising a stationary carrier for supporting said electro-magnet, and wherein said armature is directly provided at least on that leaf spring which faces away from said electro-magnet.

5. The weft thread brake of claim 1, wherein said individually controllable force application means comprises pressure means responsive to a controllable pressurizing fluid.

6. The weft thread brake of claim 5, further comprising an abutment member arranged for cooperation with said pressure means so that both leaf springs can be pressed against said abutment member located outside said two leaf springs.

7. The weft thread brake of claim 1, wherein said individually controllable force application means comprise an adjustable stop.

8. The weft thread brake of claim 1, wherein said individually controllable force application means comprise an adjustable controller (12) for influencing of the stepwise braking effect.

* * * * *